US008215348B1

(12) United States Patent
Schreiber

(10) Patent No.: US 8,215,348 B1
(45) Date of Patent: Jul. 10, 2012

(54) COIN CONVENIENCE SYSTEMS

(76) Inventor: Paul Schreiber, Denville, NJ (US)

( * ) Notice: Subject to any disclaimer, the term of this patent is extended or adjusted under 35 U.S.C. 154(b) by 879 days.

(21) Appl. No.: 12/245,725

(22) Filed: Oct. 4, 2008

Related U.S. Application Data

(60) Provisional application No. 60/986,233, filed on Nov. 7, 2007, provisional application No. 61/024,161, filed on Jan. 28, 2008, provisional application No. 61/088,315, filed on Aug. 12, 2008.

(51) Int. Cl.
*A45C 1/00* (2006.01)

(52) U.S. Cl. ..... 150/112; 150/152; 150/117; 150/150; 150/113

(58) Field of Classification Search ..... 150/112, 150/100, 113, 117, 150, 129, 151, 152, 106; 224/236, 43.1
See application file for complete search history.

(56) References Cited

U.S. PATENT DOCUMENTS 675,687 A 6/1901 Vogelgesang
894,510 A 7/1908 Levy
1,981,975 A * 11/1934 Weimar ..... 150/112
2,687,159 A * 8/1954 Dobbs et al. ..... 150/151
2,700,009 A 1/1955 Rudavsky
2,726,030 A * 12/1955 Levin ..... 150/151
2,750,978 A * 6/1956 Hume ..... 150/117
2,797,719 A * 7/1957 Hume ..... 150/117
2,827,094 A 3/1958 Collings
5,782,280 A * 7/1998 Berry ..... 150/113
6,945,293 B1 9/2005 Newton

* cited by examiner

*Primary Examiner* — Anthony Stashick
*Assistant Examiner* — Cynthia Collado
(74) *Attorney, Agent, or Firm* — Stoneman Law Patent Group; Martin L. Stoneman; Eric Fish

(57) ABSTRACT

A system relating to improved coin currency containment, collection, and retrieval, when carrying or utilizing a purse or pocketbook. The system provides an exterior-mounted coin slot that directs loose coin from such coin slot into an interior expandable zippered pocket within the pocketbook. Alternately, the pocket has a window to view such stored coin in the internal coin pocket portion, assisting a user in easy recognition and retrieval of desired coin from the pocket. It may, under appropriate circumstances, also be used on other personal item carriers such as, purses, handbags, wallets, backpacks, messenger bags, attachés, fanny packs, duffel bags, luggage, etc.

27 Claims, 12 Drawing Sheets

COIN CONVENIENCE SYSTEMS

CROSS-REFERENCE TO RELATED APPLICATIONS

The present application is related to and claims priority from prior provisional application Ser. No. 60/986,233, filed Nov. 7, 2007, entitled "COIN CURRENCY CONTAINER SYSTEMS", and is related to and claims priority from prior provisional application Ser. No. 61/024,161, filed Jan. 28, 2008, entitled "COIN CONVENIENCE SYSTEMS", and is related to and claims priority from prior provisional application Ser. No. 61/088,315, filed Aug. 12, 2008, entitled "COIN CONVENIENCE SYSTEMS", the contents all of which are incorporated herein by this reference and are not admitted to be prior art with respect to the present invention by the mention in this cross-reference section.

BACKGROUND

This invention relates to providing a system for improved coin currency containment, collection, and retrieval, when carrying or utilizing a personal item carrier such as, pocketbooks, purses and luggage, preferably pocketbooks. More particularly, this invention relates to providing a system relating to containment, collection and retrieval of loose coins with a pocketbook.

When carrying or utilizing a pocketbook, the handling of loose coin currency can be time-consuming and inconvenient. While paper-based currency is light, easy to store and may be folded, loose coin currency is heavier than paper, hard to keep organized, more difficult to store, and more difficult to locate for retrieval when needed. Storing loose coins in pocketbooks by opening the pocketbook to place the loose coin into it and to retrieve such loose coins presents some difficulties, particularly in larger pocketbooks, as the loose coins may have moved within the pocketbook or be covered by other objects inside such pocketbook. Further, when a pocketbook is opened, dropped or not positioned vertical to the horizon, loose change stored within the pocketbook may spill out.

It would be useful to have an improved means to quickly store loose coins, to secure such coins, and to easily locate and access for retrieval such loose coins in a pocketbook.

OBJECTS AND FEATURES OF THE INVENTION

A primary object and feature of the present invention is to provide a coin convenience system overcoming the above-mentioned problems.

It is a further object and feature of the present invention to provide such a system to quickly store loose coin currency in a pocketbook without opening the pocketbook.

It is a further object and feature of the present invention to provide such a system to quickly identify loose coin currency in a pocketbook.

It is a further object and feature of the present invention to provide such a system to easily locate for retrieval, loose coin currency in a pocketbook.

It is a further object and feature of the present invention to provide such a system that is attachable to other personal item carriers such as purses, backpacks, luggage, etc.

A further primary object and feature of the present invention is to provide such a system that is efficient, inexpensive, and handy. Other objects and features of this invention will become apparent with reference to the following descriptions.

SUMMARY OF THE INVENTION

In accordance with a preferred embodiment hereof, this invention provides a pocketbook coin-handling system comprising: at least one pocketbook comprising at least one pocketbook external surface and at least one coin pocket internal to such at least one pocketbook; wherein such at least one coin pocket comprises at least one coin pocket external surface comprising such at least one pocketbook external surface; and at least one coin slot situate on such at least one coin pocket external surface; wherein such at least one coin slot is structured and arranged to permit vertical insertion of at least one coin into such at least one coin pocket. Moreover, it provides such a pocketbook coin-handling system wherein at least one portion of such at least one coin pocket external surface, comprising such at least one coin slot, comprises at least one substantially rigid member.

It also provides such a pocketbook coin-handling system wherein such at least one coin pocket comprises at least one coin pocket internal surface; and wherein such at least one coin pocket internal surface comprises at least one window structured and arranged to permit at least partial contents viewing of such least one coin pocket.

And, it provides such a pocketbook coin-handling system wherein such at least one coin pocket internal surface comprises at least one zippered closure structured and arranged to permit opening or closing of such least one coin pocket. Further, it provides such a pocketbook coin-handling system wherein such at least one coin pocket internal surface comprises at least one zippered closure structured and arranged to permit opening or closing of such least one coin pocket. Additionally, it provides such a pocketbook coin-handling system wherein: such at least one substantially rigid member comprises at least one metal portion; and such at least one metal portion comprises such at least one coin slot.

In accordance with another preferred embodiment hereof, this invention provides a pocketbook coin-handling system, relating to directing at least one coin from at least one exterior portion of at least one personal item carrier to at least one interior portion of such personal item carrier, comprising: at least one first chamber; and at least one second chamber; wherein such at least one first chamber and at least one second chamber are interconnected; wherein such at least one first chamber comprises at least one coin slot situate on the at least one exterior portion of the at least one personal item carrier; wherein such at least one second chamber comprises at least one coin storage pocket, situate on the at least one interior portion of the at least one personal item carrier, to store at least one coin; wherein such at least one first chamber comprises at least one coin director structured and arranged to direct such at least one coin from such at least one coin slot to such at least one coin storage pocket; and wherein at least one coin placed into such at least one coin slot by at least one user will be stored in such at least one coin storage pocket.

Also, it provides such a pocketbook coin-handling system wherein such at least one coin storage pocket comprises at least one zippered closure structured and arranged to prevent coin exit from such at least one coin storage pocket. In addition, it provides such a pocketbook coin-handling system wherein such at least one coin storage pocket comprises at least one window portion to view at least one portion of coin content of such at least one coin storage pocket. And, it provides such a pocketbook coin-handling system wherein such at least one coin storage pocket comprises at least one window portion to view at least one portion of coin content of such at least one coin storage pocket. Further, it provides such a pocketbook coin-handling system wherein at least one user may retrieve such at least one coin from such at least one coin storage pocket by unzipping such at least one zippered closure and removing such at least one coin.

Even further, it provides such a pocketbook coin-handling system wherein at least one user may retrieve such at least one coin from such at least one coin storage pocket by unzipping such at least one zippered closure and removing such at least one coin. Moreover, it provides such a pocketbook coin-handling system wherein such at least one first chamber is smaller than such at least one second chamber. Additionally, it provides such a pocketbook coin-handling system wherein such at least one coin director comprises at least one sloped coin directing element that assists slidably directing such at least one coin into such at least one coin storage pocket. Also, it provides such a pocketbook coin-handling system further comprising: wherein such at least one first chamber comprises at least one connector element to interconnect such at least one first chamber to such at least one second chamber; and wherein such at least one first chamber is interconnected through at least one exterior portion of the personal item.

In addition, it provides such a pocketbook coin-handling system wherein such at least one connector element comprises at least one compression clamp to compression clamp such at least one first chamber to such at least one second chamber through such at least one exterior portion of the personal item. And, it provides such a pocketbook coin-handling system wherein: such at least one external surface comprises at least one metal portion; and such at least one metal portion comprises such at least one coin slot. Further, it provides such a pocketbook coin-handling system wherein such at least one metal portion comprises indicia. Even further, it provides such a pocketbook coin-handling system wherein such indicia comprise at least one Logo.

In accordance with another preferred embodiment hereof, this invention provides a pocketbook coin-handling system comprising: at least one pocketbook comprising at least one pocketbook external surface and at least one coin pocket internal to such at least one pocketbook; wherein such at least one coin pocket comprises at least one coin pocket external surface comprising such at least one pocketbook external surface; at least one coin slot situate on such at least one coin pocket external surface; wherein such at least one coin slot is structured and arranged to permit vertical insertion of at least one coin into such at least one coin pocket; wherein at least one portion of such at least one coin pocket external surface, comprising such at least one coin slot, comprises at least one substantially rigid member; wherein such at least one coin pocket comprises at least one coin pocket internal surface; wherein such at least one coin pocket internal surface comprises at least one window structured and arranged to permit at least partial contents viewing of such least one coin pocket; and wherein such at least one coin pocket internal surface comprises at least one zippered closure structured and arranged to permit opening or closing of such least one coin pocket.

Even further, it provides such a pocketbook coin-handling system wherein: such at least one substantially rigid member comprises at least one metal portion; and such at least one metal portion comprises such at least one coin slot. Even further, it provides such a pocketbook coin-handling system wherein such at least one metal portion comprises indicia. Even further, it provides such a pocketbook coin-handling system wherein such indicia comprise at least one Logo.

In accordance with another preferred embodiment hereof, this invention provides a method of using at least one coin pocket internal to at least one pocketbook, wherein such at least one coin pocket and such at least one pocketbook share a common external wall, comprising the steps of: vertically inserting at least one coin into at least one coin slot on such common external wall, thereby transferring such at least one coin from a position external to such at least one pocketbook to a position internal to such at least one coin pocket; when such at least one coin is desired to be removed from such at least one coin pocket, opening such at least one pocketbook; and through such opening in such at least one pocketbook and through at least one entry into such at least one coin pocket, grasping such at least one coin and removing such at least one coin.

In accordance with another preferred embodiment hereof, this invention provides a coin-handling system comprising: at least one personal item carrier comprising at least one personal item carrier external surface and at least one coin pocket internal to such at least one personal item carrier; wherein such at least one coin pocket comprises at least one coin pocket external surface comprising such at least one personal item carrier external surface; and at least one coin slot situate on such at least one coin pocket external surface; wherein such at least one coin slot is structured and arranged to permit vertical insertion of at least one coin into such at least one coin pocket.

In accordance with a preferred embodiment hereof, this invention provides a purse coin-handling system comprising: at least one purse comprising at least one purse external surface and at least one coin pocket internal to such at least one purse; wherein such at least one coin pocket comprises at least one coin pocket external surface comprising such at least one pocketbook external surface; and at least one coin slot situate on such at least one coin pocket external surface; wherein such at least one coin slot is structured and arranged to permit vertical insertion of at least one coin into such at least one coin pocket; wherein such at least one coin pocket external surface comprises at least one coin pocket internal surface; wherein at least one portion of such at least one coin pocket internal surface, comprises such at least one coin slot; wherein such at least one coin pocket internal surface comprises at least one substantially rigid coin director structured and arranged to direct coin from such at least one coin slot into such at least one coin pocket.

Moreover, it provides such a pocketbook coin-handling system wherein such at least one substantially rigid coin director comprises a substantially semi-circular clamshell shape. Additionally, it provides such a pocketbook coin-handling system wherein at least one portion of such at least one coin pocket external surface, comprising such at least one coin slot, comprises at least one substantially rigid member. Also, it provides such a pocketbook coin-handling system wherein such at least one substantially rigid coin director is structured and arranged to block collapsing of such at least one coin pocket about such at least one coin slot.

DETAILED DESCRIPTION OF THE BEST MODES AND PREFERRED EMBODIMENTS OF THE INVENTION

Figure 1:
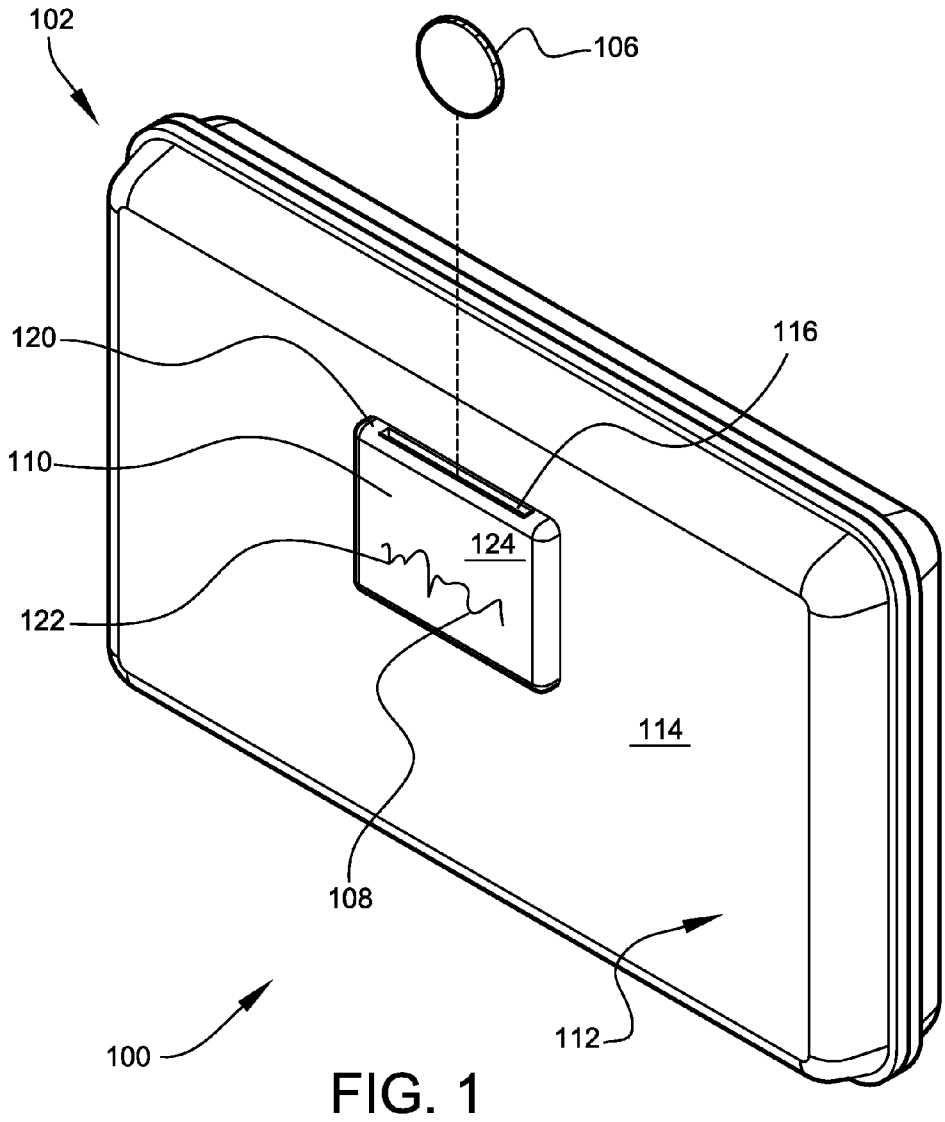
FIG. 1 shows a perspective view, illustrating at least one pocketbook utilizing the coin convenience system, according to a preferred embodiment of the present invention.

FIG. 1 shows a perspective view illustrating a personal item carrier, highly-preferably pocketbook 102, utilizing coin convenience system 100, according to a preferred embodiment of the present invention. Preferably, coin convenience system 100 is embodied by pocketbook 102, as shown. Upon reading this specification, those with ordinary skill in the art will now appreciate that, under appropriate circumstances, considering such issues as user preferences, cost, structural requirements, available materials, available markets, personal item carrier size, etc., other personal item carriers than pocketbooks, such as, for example, purses, handbags, wallets, backpacks, messenger bags, attachés, fanny packs, duffel bags, luggage, etc., may suffice. Preferably, coin convenience system 100 provides a system relating to containment, collection and retrieval of loose coins 106 utilizing pocketbook 102, as described and shown herein.

Coin convenience system 100 preferably comprises at least one coin chambering mechanism 110, as shown. Coin chambering mechanism 110 is preferably situate on at least one exterior portion 112 of pocketbook 102, as shown. Preferably, coin chambering mechanism 110 is situate on upper portion 114 of exterior portion 112 and is preferably placed centered (transversely) on pocketbook 102, as shown. Upon reading this specification, those with ordinary skill in the art will now appreciate that, under appropriate circumstances, considering such issues as user preferences, cost, structural requirements, available materials, marketing strategy, personal item carrier size, etc., other placement locations for the coin chambering mechanism such as, for example, off-center, corner, diagonal, etc., may suffice.

Preferably, coin chambering mechanism 110 comprises at least one coin slot 116, as shown, preferably situate in a plane transverse to a plane of exterior portion 112. Thus, coin 106 may be inserted through coin slot 116 (into coin chambering mechanism 110) by movement substantially parallel to exterior portion 112 (vertically downward when pocketbook 102 is situate in or carried in typical positions), as shown (at least embodying herein wherein such at least one first chamber comprises at least one coin slot situate on the at least one exterior portion of the at least one pocketbook). Preferably, coin slot 116 is located on a top portion 120 of coin chambering mechanism 110, as shown and further described below.

Preferably, coin slot 116 provides an aperture large enough to allow passage of multiple-sizes of coins 106, but not large enough for items thicker or wider than the preferred coins to pass, as shown. Preferably, coin slot 116 will accommodate coin 106 in any currency, preferably at least United States currency from about a dime-size coin to about a dollar-size coin. Preferably, coin slot 116 is about 3/32 inch in depth (transverse) and about one-inch in width (longitudinal), as shown. Upon reading this specification, those with ordinary skill in the art will now appreciate that, under appropriate circumstances, considering such issues as single or multiple coin slots, coin size, currency, user-preferences, materials, technological advances, cost, structural requirements, available materials, etc., other coin slot dimensions such as, for example, wider, less wide, more depth, less depth, etc., may suffice.

Preferably, coin chambering mechanism 110 comprises at least one indicia placement portion 122, as shown. Preferably, coin chambering mechanism 110 is comprised of at least one material onto which indicia 108 such as, for example, at least one Logo, trademark, service mark, number, saying or other marketing-assisting indicia may be placed, molded and/or stamped, preferably on at least one exterior-facing portion 124 of coin chambering mechanism 110, preferably situate on exterior portion 112 of pocketbook 102, as shown. In the described preferred embodiment of FIG. 1, coin chambering mechanism 110 preferably comprises material of metal, preferably steel, preferably chromed steel. Indicia 108 are preferably stamped into the preferably metal material. Upon reading this specification, those with ordinary skill in the art will now appreciate that, under appropriate circumstances, considering such issues as user preferences, cost, structural requirements, available materials, technological advances, new materials, etc., other materials such as, for example, other metals, plastics, carbon fiber, hardwoods, ceramics, natural stone, etc., may suffice.

Figure 2:
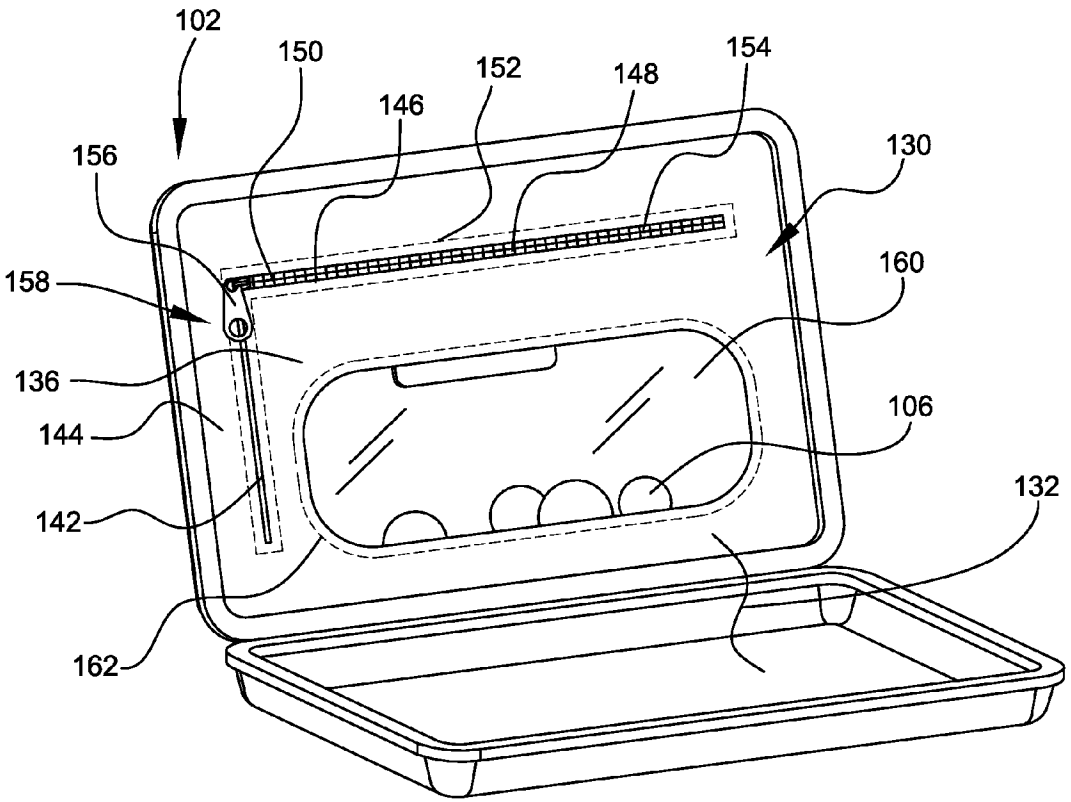
FIG. 2 shows a perspective view, illustrating an interior coin pocket of such pocketbook, according to the preferred embodiment of FIG. 1.
Figure 3:
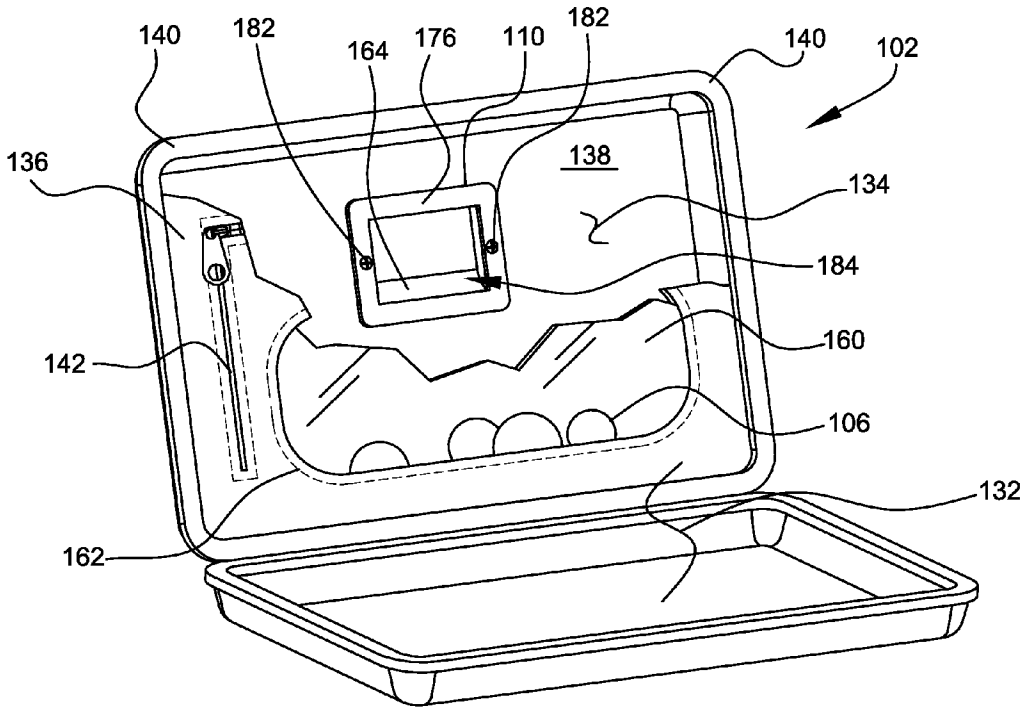
FIG. 3 shows a perspective view, partially in section, illustrating a closable coin containing portion of the interior coin pocket, according to the preferred embodiment of FIG. 1.

FIG. 2 shows a perspective view, illustrating an interior coin pocket 130 of pocketbook 102 according to the preferred embodiment of FIG. 1. FIG. 3 shows a perspective view, partially in section, illustrating the closable coin containing portion 134 of interior coin pocket 130 according to the preferred embodiment of FIG. 2.

Preferably, pocketbook 102 comprises at least one interior portion 132, preferably comprising at least one interior coin pocket 130 (at least embodying herein at least one second chamber; and, at least embodying herein wherein such at least one second chamber comprises at least one coin storage pocket, situate on the at least one interior portion of the at least one pocketbook, to store at least one coin), as shown. Preferably, interior coin pocket 130 is directly adjacent exterior portion 112 such that interior coin pocket 130 slightly protrudes out from the centerline 126 (See FIG. 4B) of pocketbook 102, as shown (at least embodying herein at least one pocketbook comprising at least one pocketbook external surface and at least one coin pocket internal to such at least one pocketbook). Preferably, coin chambering mechanism 110 assists directing loose coin 106 from coin slot 116 into interior coin pocket 130, as shown. Interior coin pocket 130 preferably comprises at least one closable coin containing portion 134 that preferably contains loose coin 106 when such loose coin 106 is directed into such closable coin containing portion 134, as shown.

Preferably, at least about half of interior coin pocket 130 comprises flexible barrier 136, with the other about half portion preferably being the exterior portion 112 of pocketbook 102, as shown, highly preferably being at least one shared "wall", as shown (at least embodying herein wherein such at least one coin pocket comprises at least one coin pocket external surface comprising such at least one pocketbook external surface). Preferably, flexible barrier 136 is attached to inside portion 138 of exterior portion 112 of pocketbook 102, so that interior coin pocket 130 is created between the two materials, as shown. Preferably, flexible barrier 136 comprises leather, preferably adhered by adhesive to inside portion 138, alternately preferably mechanically fixed to pocketbook 102 by clamping such flexible barrier 136 between exterior framing members 140 of pocketbook 102. Under appropriate circumstances, other pocket attachment methods may be apparent to those with ordinary skill in the art upon reading this specification.

Flexible barrier 136 preferably comprises at least one gusset 142, preferably single gusset 142, preferably on one end 144 of interior coin pocket 130, to allow expansion of such interior coin pocket 130 when filling such interior coin pocket 130 with loose coins 106, as shown. Preferably, gusset 142 is situate directly below, and coupled adjacent, closure 146, as shown. Preferably, closure 146 further comprises at least one zippered closure 148, preferably combined with fabric backing 150, preferably sewn into flexible barrier 136 by stitching 152, as shown. Preferably, zipper teeth 154 are stitched to such fabric backing 150, as shown. Upon reading this specification, those with ordinary skill in the art will now appreciate that, under appropriate circumstances, considering such issues as coin containment volume, user preferences, cost, structural requirements, available materials, etc., other pocket expansion using materials such as, for example, elastic, accordion material, additional material, flexible material, etc., may suffice.

Preferably, when zippered closure 148 is unzipped, preferably utilizing at least one zipper pull 156, a user may pull open interior coin pocket 130 and gusset 142 will also expand; whereas, when zippered closure 148 is zippered in a closed position 158 (as shown in FIG. 2), gusset 142 will only slightly expand as loose coins 106 fill interior coin pocket 130. Upon reading this specification, those with ordinary skill in the art will now appreciate that, under appropriate circumstances, considering such issues as coin containment volume, user preferences, cost, structural requirements, available materials, etc., other closures in combination with other pocket expansion using materials such as, for example, elastic, accordion material, additional material, flexible material, etc., may suffice.

Preferably, flexible barrier 136 further comprises at least one window portion 160, preferably exactly one window portion 160, as shown. Preferably, window portion 160 comprises at least one portion of translucent (sufficient to identify coins 106 within coin pocket 130) material, preferably translucent plastic, preferably sewn into flexible barrier 136 by stitching 162, as shown. Preferably, window portion 160 assists a user in easily determining the content of the interior coin pocket 130 and, if such loose coins 106 are present, and in what approximate quantity. Preferably, window portion 160 is durable and not easily damaged by loose coins 106, preferably comprising a thickness range of about 3 millimeters to about 20 millimeters of material thickness. In at least one preferred embodiment, when flexible barrier 136 is leather with a thickness of about 12-15 millimeters, a preferred thickness of window portion 160 is about 10 millimeters. Upon reading this specification, those with ordinary skill in the art will now appreciate that, under appropriate circumstances, considering such issues as material advances, cost, structural requirements, available materials, etc., other material thicknesses such as, for example, more or less than 3 millimeters to 20 millimeters, etc., may suffice.

Figure 4A:
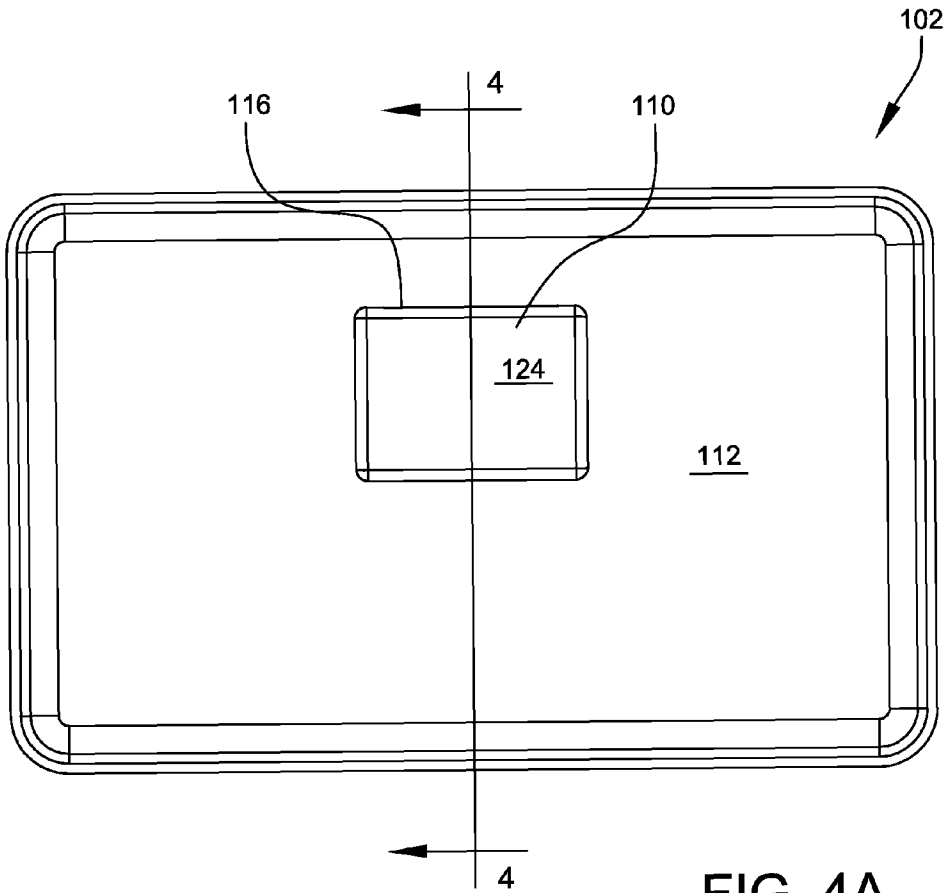
FIG. 4A shows a front-facing elevation view, of the coin chambering mechanism, according to the preferred embodiment of FIG. 1.
Figure 4B:
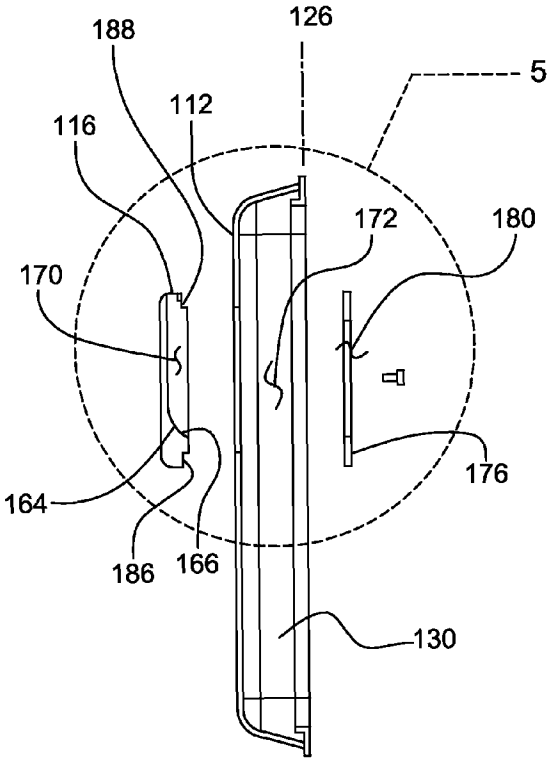
FIG. 4B shows a sectional view, through the section 4-4 of FIG. 4A.
Figure 5:
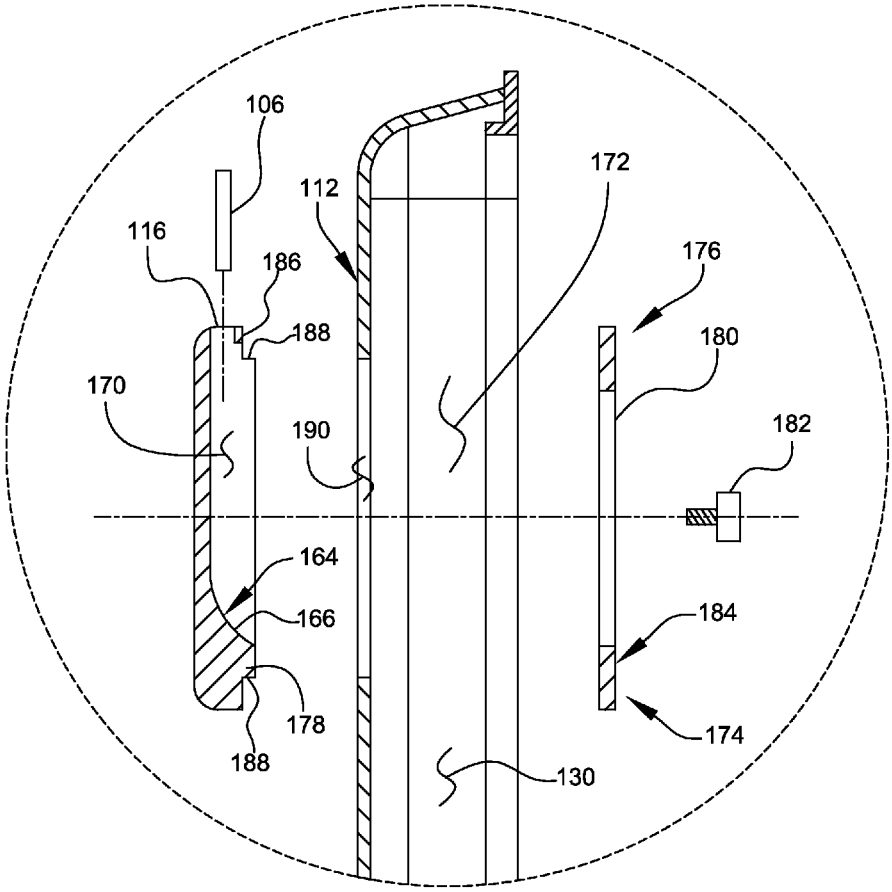
FIG. 5 shows an enlarged view of FIG. 4B.

FIG. 4A shows a front-facing elevation view of the coin chambering mechanism 110 according to the preferred embodiment of FIG. 1. FIG. 4B shows a sectional view, through the section 4-4 of FIG. 4A, according to the preferred embodiment of FIG. 1. FIG. 5 shows an enlarged view of FIG. 4B.

In a preferred embodiment, coin chambering mechanism 110 is preferably about 1¾ inch wide, about 1½ inches tall and about ⅜ inch in depth, as shown. Upon reading this specification, those with ordinary skill in the art will now appreciate that, under appropriate circumstances, considering such issues as pocketbook/personal-item-carrier size, single or multiple coin slots, coin size, currency, user-preferences, materials, technological advances, cost, structural requirements, available materials, etc., other coin slot dimensions such as, for example, wider, less wide, more depth, less depth, etc., may suffice.

Preferably, coin chambering mechanism 110 comprises at least one coin directing element 164 (at least embodying herein wherein such at least one first chamber comprises at least one coin director structured and arranged to direct such at least one coin from such at least one coin slot to such at least one coin storage pocket), preferably comprising at least one sloped portion 166 that assists slidably directing loose coin 106 from coin slot 116 into the interconnected interior coin pocket 130, as shown (this arrangement at least embodies herein wherein such at least one first chamber and at least one second chamber are interconnected).

Preferably, coin chambering mechanism 110 comprises at least one first chamber 170, preferably into which loose coin 106 travels from coin slot 116, as shown. Preferably, loose coin 106 is directed by coin directing element 164, preferably utilizing gravity in combination with sloped portion 166, to direct the loose coin 106 from such first chamber 170 into at least one second chamber 172, most preferably into interior coin pocket 130, as shown (this arrangement at least embodies herein wherein at least one coin placed into such at least one coin slot by at least one user will be stored in such at least one coin storage pocket). Upon reading this specification, those with ordinary skill in the art will now appreciate that, under appropriate circumstances, considering such issues as coin size, coin volume, user preferences, cost, structural requirements, available materials, etc., other coin directing elements such as, for example, serpentine elements, multiple sloped elements, grooves, deflectors, etc., may suffice.

Preferably, coin chambering mechanism 110 attaches to exterior portion 112 of pocketbook 102 using at least one clamping mechanism 174 (see FIG. 5 for best understanding), preferably comprising at least one ring 176, preferably metal, preferably with matching opening 180 to coin chambering mechanism 110 so that only rear periphery portion 178, preferably circumferential about coin chambering mechanism 110, is clamped against exterior portion 112 of pocketbook 102, as shown. Preferably, clamping mechanism 174 (ring 176) is screwed into rear periphery portion 178 preferably using screws 182, as shown, preferably two screws 182, preferably set flush with the face 184 of ring 176 when fully screwed-in, preferably placed about one-hundred-eighty-degrees apart, as shown (see FIG. 2). Upon reading this specification, those with ordinary skill in the art will now appreciate that, under appropriate circumstances, considering such issues as cost, structural requirements, available materials, etc., other attachment/clamp arrangements, such as, for example, more screws, rivets, bolts, etc., may suffice.

Preferably, coin chambering mechanism 110 further comprises at least one notched periphery 186, preferably L-shaped, wherein at least one lower leg portion 188 of the L-shape fits closely within and adjacent opening 190 through exterior portion 112, preferably assisting the clamping of coin chambering mechanism 110 to exterior portion 112 of pocketbook 102, and preferably aligning chamber 170 and chamber 172 so that such loose coins 106 will be directed by coin directing element 164 from chamber 170 into chamber 172 and thereby into interior coin pocket 130, as shown and described herein. Upon reading this specification, those with ordinary skill in the art will now appreciate that, under appropriate circumstances, considering such issues as pocketbook or personal-item-carrier size, single or multiple coin slots, coin size, currency, user-preferences, materials, technological advances, cost, structural requirements, available materials, etc., other coin directing arrangements such as, for example, serpentine coin directors, convex coin directors, concave coin directors, larger or smaller chambers, etc., may suffice. Further, upon reading this specification, those with ordinary skill in the art will now appreciate that, under appropriate circumstances, considering such issues as personal item carrier size, single or multiple coin slots, coin size, currency, user-preferences, materials, technological advances, cost, structural requirements, available materials, etc., other coin directing arrangements such as, for example, no peripheral notch, multiple peripheral notches, ribbed notches, etc., may suffice.

In another preferred embodiment, exterior-facing portion 124 of coin chambering mechanism 110 is covered with at least one covering that essentially is the same as the material covering exterior portion 112 of pocketbook 102. Upon reading this specification, those with ordinary skill in the art will now appreciate that, under appropriate circumstances, considering such issues as personal item carrier size, user-preferences, marketing preference, available materials, technological advances, cost, structural requirements, etc., other material covering arrangements such as, for example, fabric, metal, plastic, carbon-fiber, paint, sprayed appliqué, hot-dipped color, etc., may suffice.

In operation, a user who preferably has a pocketbook 102 with the illustrated coin chambering mechanism 110 and exterior-mounted coin slot 116 first places a loose coin 106 in about a vertical position (to the horizon) into coin slot 116 (without opening the pocketbook 102) as the coin slot 116 is preferably placed to allow only vertical coin placement, as shown (at least embodying herein wherein such at least one coin slot is structured and arranged to permit vertical insertion of at least one coin into such at least one coin pocket). Next, preferably, loose coin 106 falls by gravity onto coin directing element 164, preferably comprising at least one sloped portion 166 that assists slidably directing loose coin 106 from coin slot 116 into interior coin pocket 130. Next, preferably, loose coin 106 is held in interior coin pocket 130 until such time a user desires to retrieve the coin (this arrangement at least embodies herein vertically inserting at least one coin into at least one coin slot on such common external wall, thereby transferring such at least one coin from a position external to such at least one pocketbook to a position internal to such at least one coin pocket). Preferably, when retrieving loose coins 106 from pocketbook 102, the user opens pocketbook 102 to access the interior coin pocket 130 (at least embodying herein when such at least one coin is desired to be removed from such at least one coin pocket, opening such at least one pocketbook). Preferably, loose coin 106 is identifiable through window portion 160 and such loose coin 106 is held for user retrieval. Preferably, the interior coin pocket 130 is zippered as described above and the user simply unzips zippered closure 148, preferably by grasping zipper pull 156 and pulling open the zippered closure 148. Preferably, the user then grasps a portion of the interior coin pocket 130 and pulls slightly, opening gusset 142 and exposing the loose coin 106 within the interior coin pocket 130 (this arrangement at least embodies herein through such opening in such at least one pocketbook and through at least one entry into such at least one coin pocket, grasping such at least one coin and removing such at least one coin). Preferably, once the desired loose coin 106 has been removed, the user releases the interior coin pocket 130 and zips closed zippered closure 148, thereby sealing interior coin pocket 130 and preventing loose coin 106 from leaving the interior coin pocket 130.

Figure 6A:
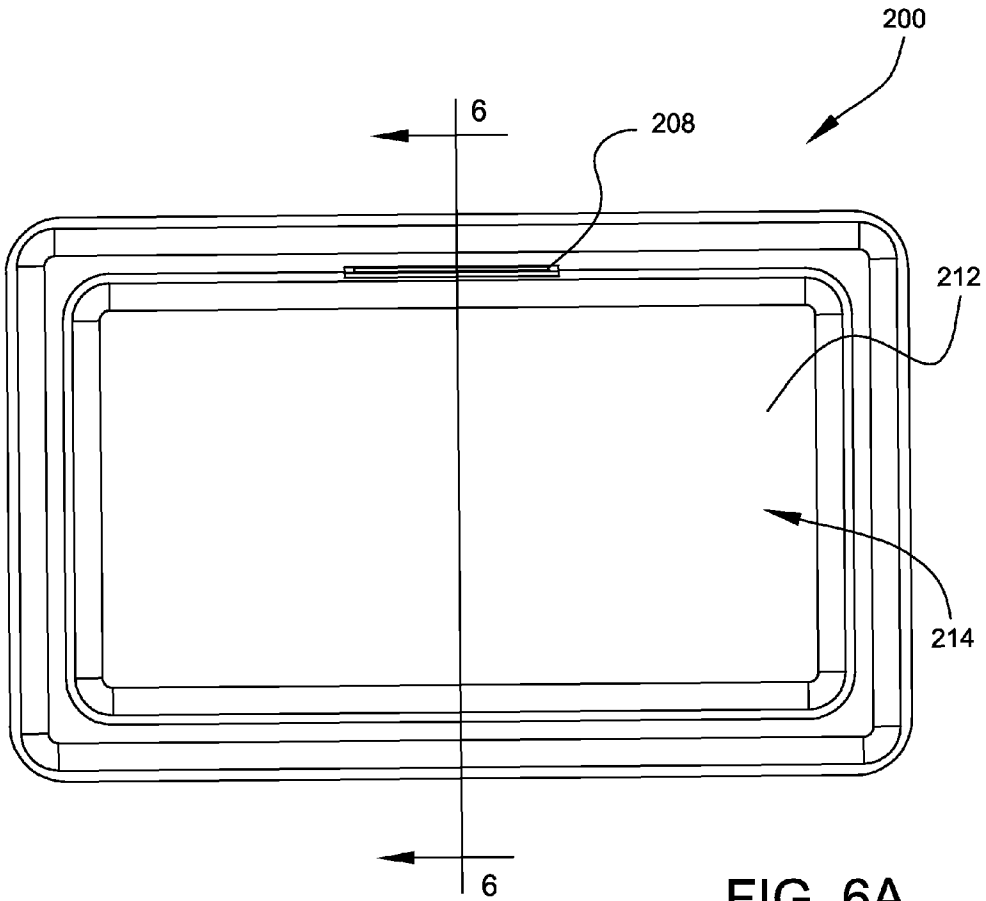
FIG. 6A shows a front-facing elevation view of the coin convenience system, according to another preferred embodiment of the present invention.
Figure 6B:
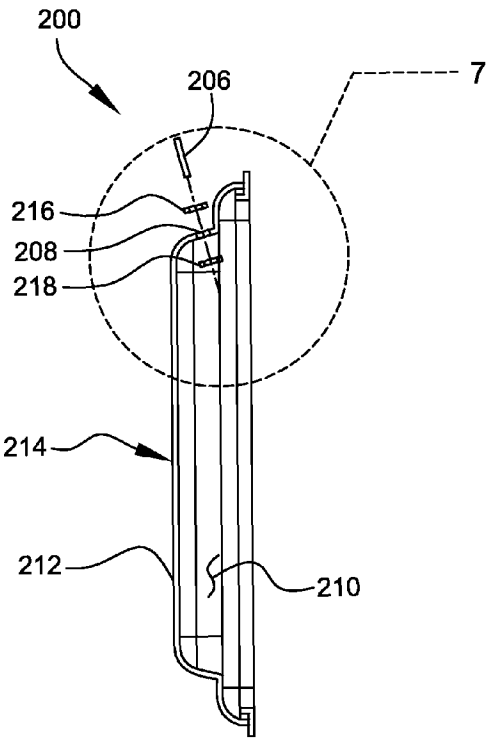
FIG. 6B shows the sectional view, through the section 6-6 of FIG. 6A.
Figure 7A:
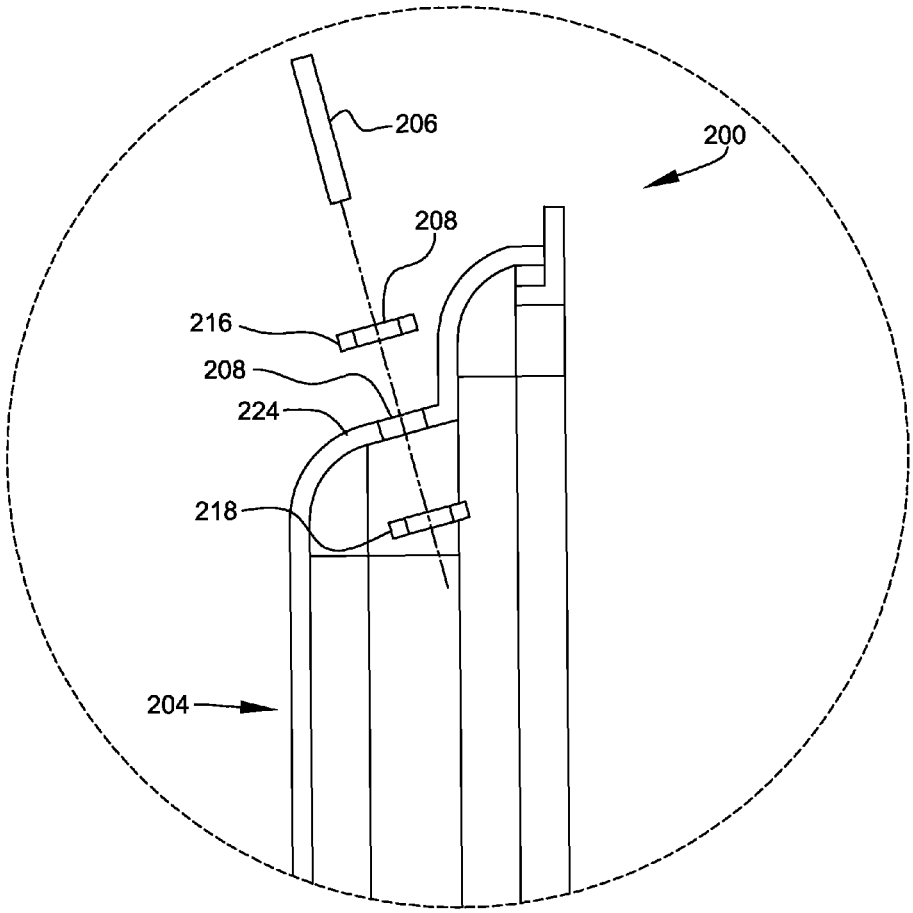
FIG. 7A shows an enlarged view of FIG. 6B.
Figure 7B:
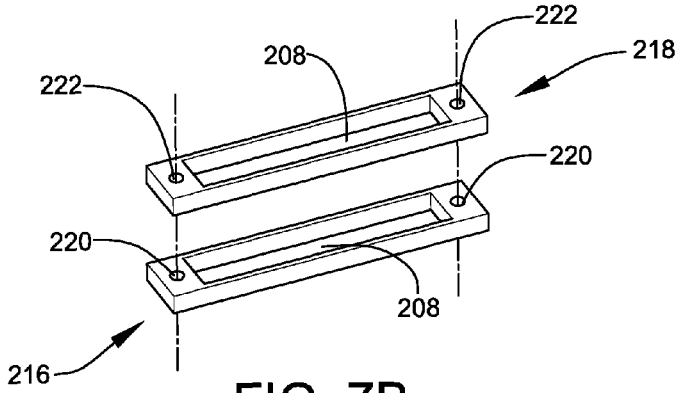
FIG. 7B shows upper and lower coin slot portions, according to the preferred embodiment of FIG. 6B.

FIG. 6A shows a front-facing elevation view of the coin convenience system 100 according to another preferred embodiment 200 of the present invention. FIG. 6B shows the sectional view through section 6-6 of FIG. 6A, according to the preferred embodiment 200 of FIG. 6A. FIG. 7A shows an enlarged view of FIG. 6B. FIG. 7B shows upper and lower coin slot portions according to the preferred embodiment of FIG. 6B.

Preferably, in embodiment 200, loose coin 206 is placeable through at least one coin slot 208, preferably located exterior of pocketbook 204, as shown. Preferably, interior coin pocket 210 is formed into the pocketbook 204, so that at least one exterior portion 212 of interior coin pocket 210 comprises a semi-rigid formed portion 214 (rectangular in the illustrated example of FIG. 6A).

Preferably, coin slot 208 comprises at least one upper portion 216 and at least one lower portion 218, preferably exactly one upper portion 216 and exactly one lower portion 218, as shown. Preferably, upper portion 216 and lower portion 218 are rigid members, preferably metal, preferably steel, preferably chrome-coated steel, preferably fastened together, preferably screwed together, preferably clamped onto at least one portion of material from the pocketbook 204, as shown (this arrangement at least embodies herein wherein at least one portion of such at least one coin pocket external surface, comprising such at least one coin slot, comprises at least one substantially rigid member). Preferably, upper portion 216 comprises screw thread receivers 220, preferably two screw thread receivers 220 located on each longitudinal end of upper portion 216, as shown (See FIG. 7B). Preferably, lower portion 218 comprises two screw apertures 222 through which a small screw, with threading matching the screw thread receivers 220, may be inserted through and threaded into the screw thread receivers 220. Preferably, when the one upper portion 216 and lower portion 218 are connected together, they form a singular coin slot 208, as shown (at least embodying herein wherein such at least one substantially rigid member comprises at least one metal portion and wherein such at least one metal portion comprises such at least one coin slot).

Preferably, coin slot 208 is placed along the top ridge 224 of semi-rigid formed portion 214, a shown. Preferably, coin slot 208 is also centered in top ridge 224 of semi-rigid formed portion 214 longitudinally, as shown (see FIG. 6A).

Figure 8:
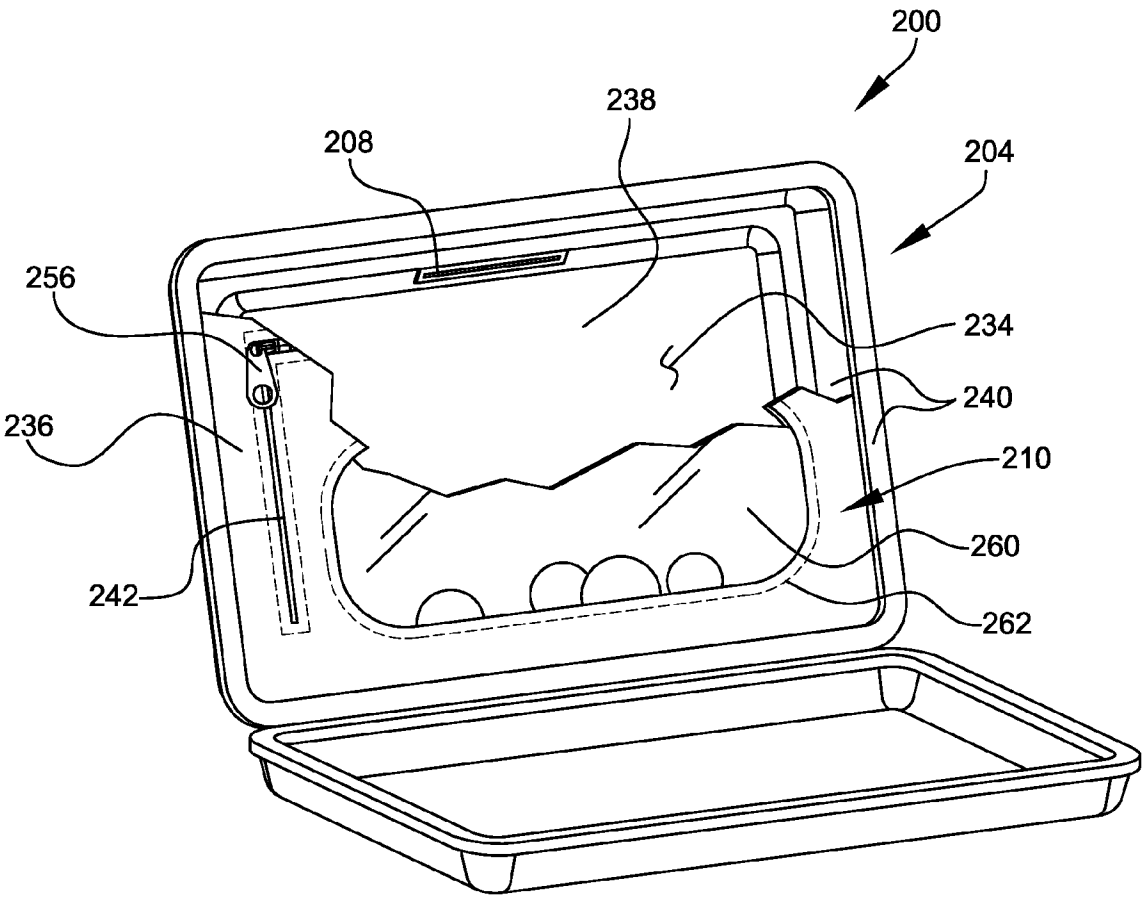
FIG. 8 shows a perspective view, illustrating an interior coin pocket of a pocketbook, according to the preferred embodiment of FIG. 6A.
Figure 9:
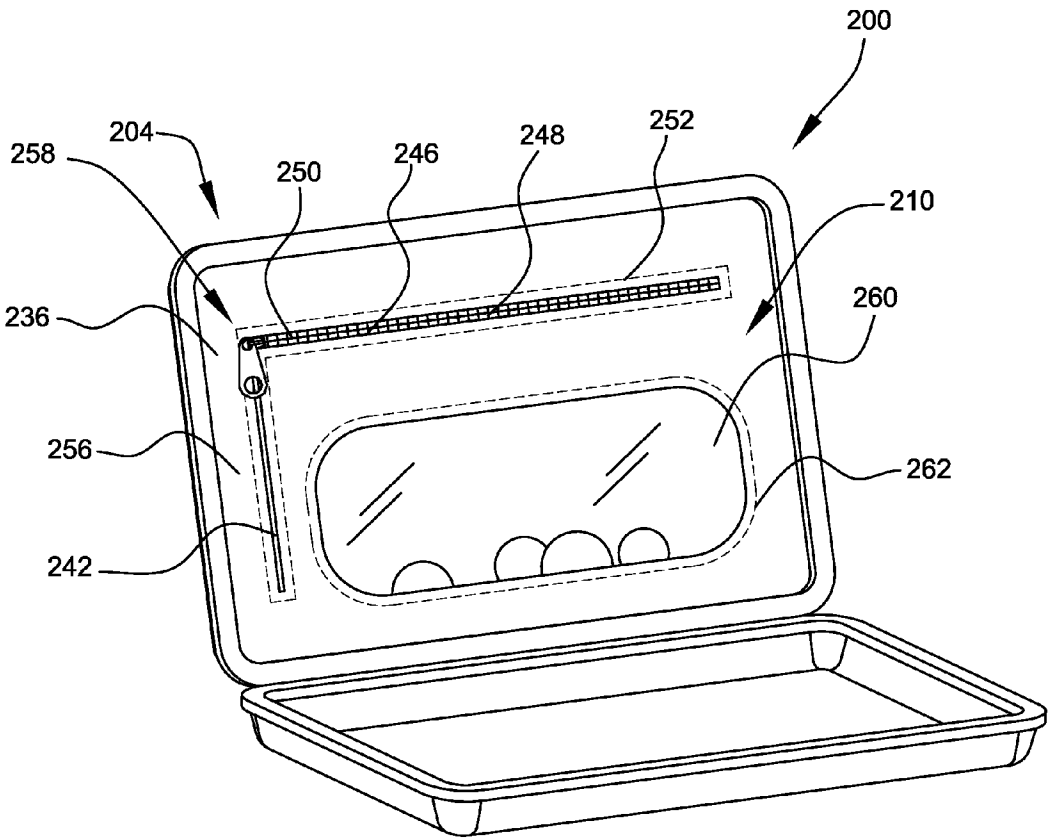
FIG. 9 shows a perspective view, partially in section, illustrating the interior portion of the coin pocket, according to the preferred embodiment of FIG. 8.

FIG. 8 shows a perspective view, illustrating an interior coin pocket 210 of the pocketbook 204 according to the preferred embodiment 200 of FIG. 6A. FIG. 9 shows a perspective view, partially in section, illustrating interior coin pocket 210 according to the preferred embodiment of FIG. 8.

Preferably, interior coin pocket 210 comprises at least one closable coin containing portion 234 that contains loose coin 206 that is directed into such closable coin containing portion 234, as shown.

Preferably, at least one about half of interior coin pocket 210 comprises at least one flexible barrier 236, with the other half being at least a portion of exterior portion 212 of pocketbook 204, as shown (being preferably semi-rigid material). Preferably exterior portion 212 comprises a covering that is the same as at least one other exterior portion of pocketbook 204, so that the exterior of pocketbook 204 appears to be homogenous except for coin slot 208.

Preferably, flexible barrier 236 is attached to the inside portion 238 of the exterior portion 212 of pocketbook 204, so that a pocket is created between the two materials, as shown.

Preferably, flexible barrier 236 (at least embodying herein wherein such at least one coin pocket comprises at least one coin pocket internal surface) is leather, preferably adhered by adhesive to the inside portion and/or mechanically fixed to pocketbook 204 by clamping such flexible barrier 236 between exterior framing members 240 of pocketbook 204, as shown. Those with ordinary skill in the art will now appreciate that upon reading this specification and by their understanding the art of pocket attachment to personal item carriers as described herein, methods of attaching such closable pockets to such interiors of such personal item carriers will be understood by those knowledgeable in such art.

Preferably, flexible barrier 236 comprises at least one gusset 242, preferably a single gusset 242, preferably on one end 244 of interior coin pocket 210, to allow expansion of such interior coin pocket 210 when filling with loose coin 206, as shown. Preferably, gusset 242 is situate directly below and coupled adjacent closure 246, as shown. Preferably, closure 246 comprises a zippered closure 248, preferably combined with fabric backing 250, preferably sewn into the flexible barrier 236 by stitching 252, as shown. Preferably, zipper teeth 254 are stitched to such fabric backing 250, as shown. Upon reading this specification, those with ordinary skill in the art will now appreciate that, under appropriate circumstances, considering such issues as coin containment volume, user preferences, cost, structural requirements, available materials, etc., other pocket expansion using materials such as, for example, elastic, accordion material, additional material, flexible material, etc., may suffice.

Preferably, when zippered closure 248 is unzipped, preferably utilizing at least one zipper pull 256, a user may pull open interior coin pocket 210 and gusset 242 will also expand whereas, when zippered closure 248 is zippered in a closed position 258 (as shown in FIG. 2), gusset 242 will only slightly expand as loose coin 106 fills interior coin pocket 210. The above arrangement at least embodies herein wherein such at least one coin pocket internal surface comprises at least one zippered closure structured and arranged to permit opening or closing of such least one coin pocket.

Preferably, flexible barrier 236 further comprises at least one window portion 260 (at least embodying herein wherein such at least one coin pocket internal surface comprises at least one window structured and arranged to permit at least partial contents viewing of such least one coin pocket), preferably exactly one window portion 260, as shown. Preferably, window portion 260 comprises at least one portion of translucent material, preferably translucent plastic, preferably sewn into the flexible barrier 236 by stitching 262, as shown. Preferably, window portion 260 assists a user in easily determining the content of the interior coin pocket 210 and, if such loose coin 206 is present and in what approximate quantity. Preferably, such window portion 260 is durable and not easily damaged by loose coin 206, preferably comprising a range of about 3 millimeters to about 20 millimeters of material thickness. In at least one preferred embodiment, when the flexible barrier 236 is leather with a thickness of about 12-15 millimeters in thickness, a preferred window portion 260 thickness is about 10 millimeters. Upon reading this specification, those with ordinary skill in the art will now appreciate that, under appropriate circumstances, considering such issues as material advances, cost, structural requirements, available materials, etc., other material thicknesses such as, for example, more or less than 3 mils to 20 mils, etc., may suffice.

Figure 10:
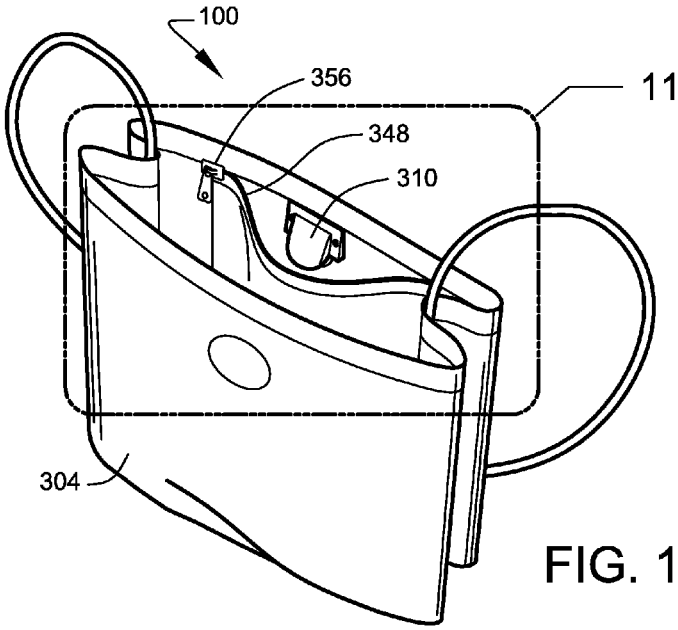
FIG. 10 shows a perspective view, illustrating a purse utilizing a coin chambering mechanism of the coin convenience system, according to another preferred embodiment of the present invention.
Figure 11:
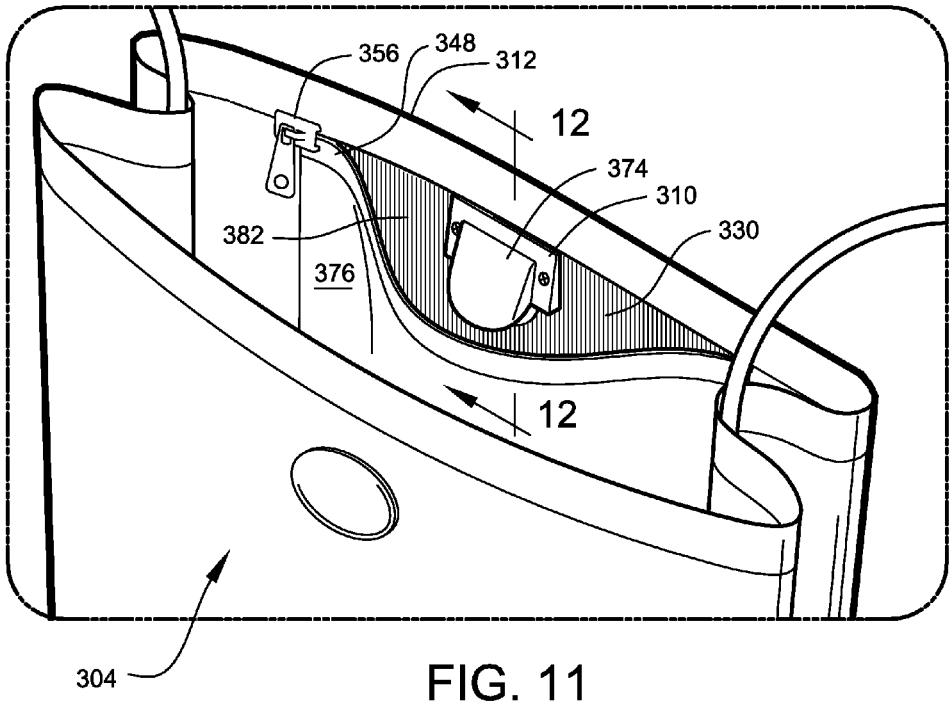
FIG. 11 shows an enlarged view of Detail 11 of FIG. 10.
Figure 12:
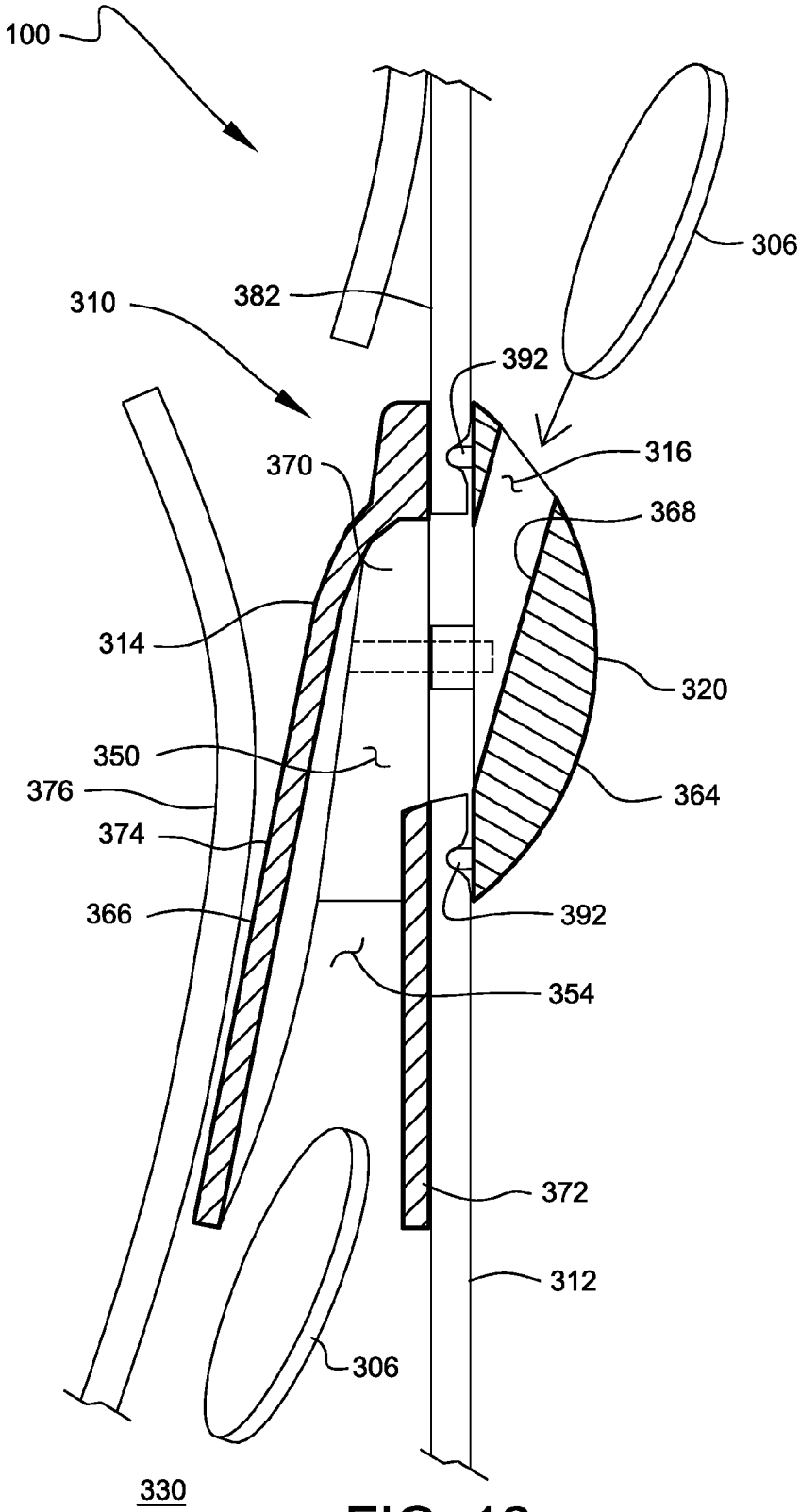
FIG. 12 shows a section view through section 12-12 of FIG. 10.

FIG. 10 shows a perspective view, illustrating a purse 304 utilizing a coin chambering mechanism 310 of the coin convenience system 100, according to another preferred embodiment 300 of the present invention. FIG. 11 shows an enlarged view of Detail 11 of FIG. 10. FIG. 12 shows a section view through section 12-12 of FIG. 10.

Preferably, coin chambering mechanism 310 comprises at least one exterior coin slot portion 320 and at least one interior coin directing portion 314, as shown. Coin chambering mechanism 310 preferably comprises at least one first coin director 364 and at least one second coin director 366, as shown. Preferably, first coin director 364 and second coin director 366 preferably form at least one coin throat 350 and maintain at least one rigid opening 354 from coin slot 316 through to interior coin pocket 330, as shown. First coin director 364 preferably comprises at least one sloped coin directing element portion 368 to assist slidable directing of loose coin 306 from coin slot 316 into interior coin pocket 330, as shown. Second coin director 366 preferably comprises at least one sloped coin directing element portion 372 and comprises a rigid shelf 374 to keep flexible fabric 376 of purse 304 from impinging into the coin throat 350, as shown. Preferably, one sloped coin directing element portion 372 and rigid shelf 374 form a clamshell shape to assist directing loose coin 306 into interior coin pocket 330 and assists maintaining rigid opening 354 from coin slot 316 through to interior coin pocket 330, regardless of how full purse 304 is filled by user and with or without an almost filled interior coin pocket 330.

In other words, coin chambering mechanism 310 preferably comprises at least one first chamber 370, preferably into which loose coin 306 travels from coin slot 316, as shown.

Coin chambering mechanism 310 is preferably about 2 inches wide, about 1½ inches tall and about ⅜ inch in depth, as shown. Upon reading this specification, those with ordinary skill in the art will now appreciate that, under appropriate circumstances, considering such issues as pocketbook/personal-item-carrier size, single or multiple coin slots, coin size, currency, user-preferences, materials, technological advances, cost, structural requirements, available materials, etc., other coin slot dimensions such as, for example, wider, less wide, more depth, less depth, etc., may suffice.

Preferably, loose coin 306 is directed by coin director 364, preferably utilizing gravity in combination with sloped coin directing portion 368, to direct the loose coin 306 from such first chamber 370 into interior coin pocket 330, as shown and described above. Upon reading this specification, those with ordinary skill in the art will now appreciate that, under appropriate circumstances, considering such issues as coin size, coin volume, user preferences, cost, structural requirements, available materials, etc., other coin directing elements such as, for example, serpentine elements, multiple sloped elements, grooves, deflectors, etc., may suffice.

Preferably, coin chambering mechanism 310 attaches to exterior portion 312 of purse 304 using at least one clamping mechanism 390, as shown. Clamping mechanism 390 preferably comprising first coin director 364 and second coin director 366, preferably clamped together, preferably using two screws 378, preferably placed on each longitudinal end 379 of the coin chambering mechanism 310, as shown.

First coin director 364 and second coin director 366 preferably are essentially comprised of metal. Upon reading this specification, those with ordinary skill in the art will now appreciate that, under appropriate circumstances, considering such issues as design preference, user preferences, marketing preferences, cost, structural requirements, available materials, technological advances, etc., other material arrangements such as, for example, plastic, wood, ceramic, carbon-fiber, stone, etc., may suffice.

First coin director 364 is preferably placed and clamped against exterior portion 312 of purse 304, as shown. Second coin director 366 is preferably placed and clamped along at least one interior portion 382 of purse 304, preferably opposite first coin director 364, as shown.

Figure 14:
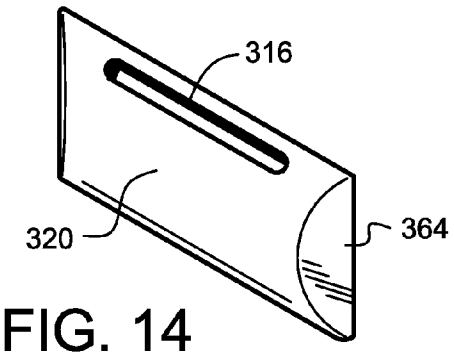
FIG. 14 shows a front perspective view, of the coin slot of the coin convenience device, according to the preferred embodiment of FIG. 10.
Figure 15:
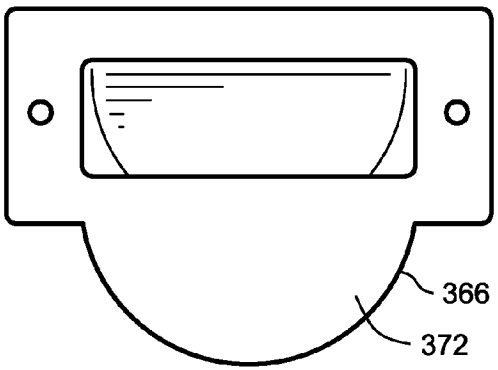
FIG. 15 shows a rear perspective view, of the coin director of the coin chambering mechanism 310, according to the preferred embodiment of FIG. 10.
Figure 13:
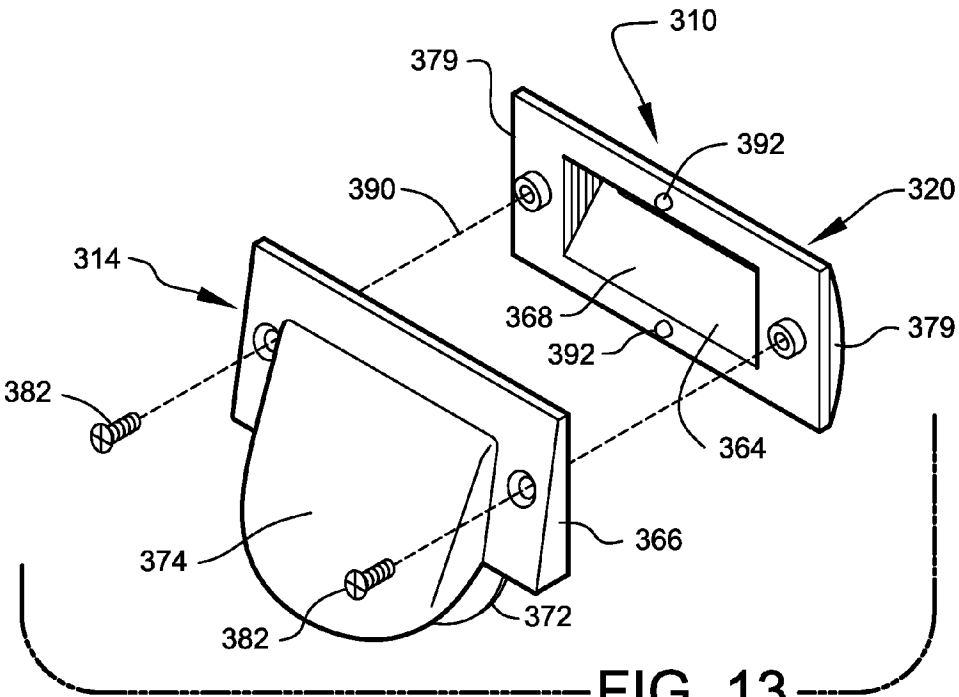
FIG. 13 shows an exploded view, of the coin chambering mechanism, according to the preferred embodiment of FIG. 10.

FIG. 13 shows an exploded view of the coin chambering mechanism 310 according to the preferred embodiment of FIG. 10. FIG. 14 shows a front perspective view of the coin slot 316 of the coin chambering mechanism 310 of FIG. 10. FIG. 15 shows a rear perspective view of the coin director 364 of the coin chambering mechanism 310 of FIG. 10.

During clamping of the coin chambering mechanism 310 to purse 304, first coin director 364 and second coin director 366 are aligned preferably as shown and pressed with flexible fabric 376 in between. Preferably, first coin director 364 comprises pins 392, preferably used to assist holding flexible fabric 376 from slipping or bunching after being clamped with clamping mechanism 390, as shown. Preferably screws 378 are used to clamp together the two portions first coin director 364 and second coined director 366, as shown. Upon reading this specification, those with ordinary skill in the art will now appreciate that, under appropriate circumstances, considering such issues as design preference, user preferences, marketing preferences, cost, structural requirements, available materials, technological advances, etc., other clamping arrangements such as, for example, multiple screws, through-pins, rivets, adhesive, etc., may suffice.

Preferably, screws 378 are about ¼ inch in length and assist clamping first coin director 364 and second coin director 366 together when a flexible fabric 376 is placed between the two, as stated above and as shown. Preferably, flexible fabric 376 is about ⅛ inch thick. Preferably, flexible fabric is leather. Upon reading this specification, those with ordinary skill in the art will now appreciate that, under appropriate circumstances, considering such issues as design preference, user preferences, marketing preferences, cost, structural requirements, available materials, technological advances, etc., other materials such as, for example, plastic, cotton, polyester, vinyl, etc., may suffice.

In operation, a user who preferably has a purse 304 with the illustrated coin chambering mechanism 310 and exterior-mounted coin slot 316, first places a loose coin 306 in about a vertical position (to the horizon) into coin slot 316 (without opening the purse 304) as the coin slot 316 is preferably placed to allow only vertical coin placement, as shown. Next, preferably, loose coin 306 falls by gravity onto sloped coin directing element portion 368 that assists slidably directing loose coin 306 from coin slot 316 into interior coin pocket 330. Next, preferably, loose coin 306 is held in interior coin pocket 330 until such time a user desires to retrieve the coin. Preferably, when retrieving loose coins 306 from pocketbook 302, the user opens pocketbook 302 to access the interior coin pocket 330. Preferably, loose coin 306 is easily placed into interior coin pocket 330 as rigid shelf 374 preferably assists in keeping flexible fabric 376 from collapsing rigid opening 354, as shown. Preferably, the interior coin pocket 330 is zippered and a user simply unzips zippered closure 348, preferably by grasping zipper pull 356 and pulling open the zippered closure 348. Preferably, the user then interior coin pocket 330 exposing the loose coin 306 within the interior coin pocket 330. Preferably, once the desired loose coin 306 has been removed, the user releases the interior coin pocket 330 and zips closed zippered closure 348, thereby sealing interior coin pocket 330 and preventing loose coin 306 from leaving the interior coin pocket 330.

Although applicant has described applicant's preferred embodiments of this invention, it will be understood that the broadest scope of this invention includes modifications such as diverse shapes, sizes, and materials. Such scope is limited only by the below claims as read in connection with the above specification. Further, many other advantages of applicant's invention will be apparent to those skilled in the art from the above descriptions and the below claims.

What is claimed is:

1. A pocketbook coin-handling system comprising:

a) at least one pocketbook comprising at least one pocketbook external surface and at least one coin pocket internal to said at least one pocketbook;

b) wherein said at least one coin pocket comprises at least one coin pocket external surface comprising said at least one pocketbook external surface;

c) wherein said at least one coin pocket comprises at least one coin pocket internal surface;

d) wherein said at least one coin pocket internal surface comprises at least one zippered closure structured and arranged to permit opening or closing of said least one coin pocket;

e) at least one coin slot situate on said at least one coin pocket external surface; and f) wherein said at least one coin slot is structured and arranged to permit vertical insertion of at least one coin into said at least one coin pocket.

2. The pocketbook coin-handling system according to claim 1 wherein at least one portion of said at least one coin pocket external surface, comprising said at least one coin slot, comprises at least one substantially rigid member.

3. A pocketbook coin-handling system according to claim 1 wherein:

a) said at least one coin pocket comprises at least one coin pocket internal surface; and b) said at least one coin pocket internal surface comprises at least one window structured and arranged to permit at least partial contents viewing of said at least one coin pocket.

4. The pocketbook coin-handling system according to claim 2 wherein:

a) said at least one substantially rigid member comprises at least one metal portion; and b) said at least one metal portion comprises said at least one coin slot.

5. A pocketbook coin-handling system, relating to directing at least one coin from at least one exterior portion of at least one personal item carrier to at least one interior portion of such personal item carrier, comprising:

a) at least one first chamber; and b) at least one second chamber;

c) wherein said at least one first chamber and at least one second chamber are interconnected;

d) wherein said at least one first chamber comprises at least one coin slot situate on the at least one exterior portion of the at least one personal item carrier;

e) wherein said at least one second chamber comprises at least one coin storage pocket, situate on the at least one interior portion of the at least one personal item carrier, to store at least one coin;

f) wherein said at least one first chamber comprises at least one coin director structured and arranged to direct such at least one coin from said at least one coin slot to said at least one coin storage pocket; and g) wherein at least one coin placed into said at least one coin slot by at least one user will be stored in said at least one coin storage pocket.

6. The pocketbook coin-handling system according to claim 5 wherein said at least one coin storage pocket comprises at least one zippered closure structured and arranged to prevent coin exit from said at least one coin storage pocket.

7. The pocketbook coin-handling system according to claim 5 wherein said at least one coin storage pocket comprises at least one window portion to view at least one portion of coin content of said at least one coin storage pocket.

8. The pocketbook coin-handling system according to claim 6 wherein said at least one coin storage pocket comprises at least one window portion to view at least one portion of coin content of said at least one coin storage pocket.

9. The pocketbook coin-handling system according to claim 6 wherein at least one user may retrieve such at least one coin from said at least one coin storage pocket by unzipping said at least one zippered closure and removing such at least one coin.

10. The pocketbook coin-handling system according to claim 8 wherein at least one user may retrieve such at least one coin from said at least one coin storage pocket by unzipping said at least one zippered closure and removing such at least one coin.

11. The pocketbook coin-handling system according to claim 5 wherein said at least one first chamber is smaller than said at least one second chamber.

12. The pocketbook coin-handling system according to claim 5 wherein said at least one coin director comprises at least one sloped coin directing element that assists slidably directing such at least one coin into said at least one coin storage pocket.

13. The pocketbook coin-handling system according to claim 5 wherein:

a) said at least one first chamber comprises at least one connector element to interconnect said at least one first chamber to said at least one second chamber; and b) said at least one first chamber is interconnected through at least one exterior portion of the personal item carrier.

14. The pocketbook coin-handling system according to claim 13 wherein said at least one connector element comprises at least one compression clamp to compression clamp said at least one first chamber to said at least one second chamber through such at least one exterior portion of the personal item carrier.

15. The pocketbook coin-handling system according to claim 5 wherein:

a) said at least one external surface comprises at least one metal portion; and b) said at least one metal portion comprises said at least one coin slot.

16. The pocketbook coin-handling system according to claim 15 wherein said at least one metal portion comprises indicia.

17. The pocketbook coin-handling system according to claim 16 wherein said indicia comprises at least one Logo.

18. A pocketbook coin-handling system comprising:

a) at least one pocketbook comprising at least one pocketbook external surface and at least one coin pocket internal to said at least one pocketbook;

b) wherein said at least one coin pocket comprises at least one coin pocket external surface comprising said at least one pocketbook external surface;

c) at least one coin slot situate on said at least one coin pocket external surface;

d) wherein said at least one coin slot is structured and arranged to permit vertical insertion of at least one coin into said at least one coin pocket;

e) wherein at least one portion of said at least one coin pocket external surface, comprising said at least one coin slot, comprises at least one substantially rigid member;

f) wherein said at least one coin pocket comprises at least one coin pocket internal surface;

g) wherein said at least one coin pocket internal surface comprises at least one window structured and arranged to permit at least partial contents viewing of said at least one coin pocket; and h) wherein said at least one coin pocket internal surface comprises at least one zippered closure structured and arranged to permit opening or closing of said least one coin pocket.

19. The pocketbook coin-handling system according to claim 18 wherein:

a) said at least one substantially rigid member comprises at least one metal portion; and b) said at least one metal portion comprises said at least one coin slot.

20. The pocketbook coin-handling system according to claim 19 wherein said at least one metal portion comprises indicia.

21. The pocketbook coin-handling system according to claim 20 wherein said indicia comprises at least one Logo.

22. A method of using at least one coin pocket internal to at least one pocketbook, wherein such at least one coin pocket and such at least one pocketbook share a common external wall, comprising the steps of:

a) vertically inserting at least one coin into at least one coin slot on such common external wall, thereby transferring such at least one coin from a position external to such at least one pocketbook to a position internal to such at least one coin pocket;

b) when such at least one coin is desired to be removed from such at least one coin pocket, opening such at least one pocketbook; and c) through such opening in such at least one pocketbook and through at least one entry into such at least one coin pocket, grasping such at least one coin and removing such at least one coin.

23. A coin-handling system comprising:

a) at least one personal item carrier comprising at least one personal item carrier external surface and at least one coin pocket internal to said at least one personal item carrier;

b) wherein said at least one coin pocket comprises at least one coin pocket external surface comprising said at least one personal item carrier external surface;

c) wherein said at least one coin pocket comprises at least one coin pocket internal surface;

d) wherein said at least one coin pocket internal surface comprises at least one zippered closure structured and arranged to permit opening or closing of said least one coin pocket;

e) at least one coin slot situate on said at least one coin pocket external surface; and f) wherein said at least one coin slot is structured and arranged to permit vertical insertion of at least one coin into said at least one coin pocket.

24. A purse coin-handling system comprising:

a) at least one purse comprising at least one purse external surface and at least one coin pocket internal to said at least one purse;

b) wherein said at least one coin pocket comprises at least one coin pocket external surface comprising said at least one purse external surface;

c) wherein said at least one coin pocket comprises at least one coin pocket internal surface;

d) wherein said at least one coin pocket internal surface comprises at least one zippered closure structured and arranged to permit opening or closing of said least one coin pocket;

e) at least one coin slot situate on said at least one coin pocket external surface;

f) wherein said at least one coin slot is structured and arranged to permit vertical insertion of at least one coin into said at least one coin pocket;

g) wherein said at least one coin pocket external surface comprises said at least one coin pocket internal surface;

h) wherein at least one portion of said at least one coin pocket internal surface, comprises said at least one coin slot; and i) wherein said at least one coin pocket internal surface comprises at least one substantially rigid coin director structured and arranged to direct coin from said at least one coin slot into said at least one coin pocket.

25. The purse coin-handling system according to claim 24 wherein said at least one substantially rigid coin director comprises a substantially semi-circular clamshell shape.

26. The purse coin-handling system according to claim 24 wherein at least one portion of said at least one coin pocket external surface, comprising said at least one coin slot, comprises at least one substantially rigid member.

27. The purse coin-handling system according to claim 24 wherein said at least one substantially rigid coin director is structured and arranged to block collapsing of said at least one coin pocket about said at least one coin slot.

* * * * *

UNITED STATES PATENT AND TRADEMARK OFFICE

CERTIFICATE OF CORRECTION

PATENT NO. : 8,215,348 B1
APPLICATION NO. : 12/245725
DATED : July 10, 2012
INVENTOR(S) : Paul Schreiber It is certified that error appears in the above-identified patent and that said Letters Patent is hereby corrected as shown below:

IN THE CLAIMS:

Column 16, Claim 18 h), Line 34, “closing of said least one” should read --closing of said at least one--
Column 17, Claim 23 d), Line 8, “closing of said least one” should read --closing of said at least one--
Column 17, claim 24 d), Line 26, “closing of said least one” should read --closing of said at least one--

Signed and Sealed this
Ninth Day of October, 2012

David J. Kappos

David J. Kappos
*Director of the United States Patent and Trademark Office*